United States Patent [19]

Su et al.

[11] Patent Number: 5,058,613

[45] Date of Patent: Oct. 22, 1991

[54] ONE HAND OPERATED UMBRELLA CAPABLE OF SELF-CLOSING

[76] Inventors: Tseng Su, No. 434-2, Chung Sen Road; Yun c. Pon, No 43, Alley 18, Lane 150, Suay Tan Street, both of, Hsinchu, Taiwan, Taiwan

[21] Appl. No.: 596,204

[22] Filed: Oct. 10, 1990

[51] Int. Cl.[5] ..... A45B 11/00

[52] U.S. Cl. ..... 135/20.3; 135/24

[58] Field of Search ..... 135/20 R, 20 M, 22–24, 135/44, 31, 28, 29

[56] References Cited

U.S. PATENT DOCUMENTS 4,548,222 10/1985 Day ..... 135/20 R X

FOREIGN PATENT DOCUMENTS 123489 8/1901 Fed. Rep. of Germany ..... 135/22

1316127 12/1962 France ..... 135/23

19251 of 1901 United Kingdom ..... 135/24

*Primary Examiner*—David A. Scherbel

*Assistant Examiner*—Lan Mia

*Attorney, Agent, or Firm*—Zarley, McKee, Thomte, Voorhees & Sease

[57] ABSTRACT

A one hand operated umbrella capable of self-closing, including a center shaft of outer tube and inner tube, both of which are engaged with a spring pawl, a connector with an upper link and a lower within the shaft, and a handle with a button connected with the bottom of inner tube. While pushing the button, a slider of the umbrella will be released and to push the spring pawl inward to close and shorten automatically.

1 Claim, 4 Drawing Sheets

93
2B
91
2C
5
92
A
96
6
15
95
94
A
A
61
96
13
A 11
2
92
91
1

41

93
4
3
12
14
82
8
7

ONE HAND OPERATED UMBRELLA CAPABLE OF SELF-CLOSING

BACKGROUND OF THE SPECIFICATION

The present invention relates to a self-closing umbrella which can be operated with one hand by means of pushing action of a hand for automatic closing and shortening an umbrella.

Several types of automatic umbrellas which can be opened or closed automatically have been disclosed in the past, to take for examples, U.S. Pat. No. 4,823,821, No. 4,534,374, No. 3,906,970, No. 3,856,030, and so on. In the prior art, all known umbrellas are only capable of being opened or closed. The shaft must be manually shortened after closing the umbrella. It is obviously inconvenient for users to complete this action.

SUMMARY OF THE INVENTION

It is the purpose of this present invention, therefore, to mitigate and/or obviate the abovementioned drawbacks in the manner set forth in the detailed description of the preferred embodiment.

A primary objective of this invention is to provide a self closing and folding umbrella, which can be operated by a single action of pushing a button mounted on a handle of the umbrella.

Another objective of the present invention is to provide a one hand operated self-closing umbrella, which is capable of being easily closed and shortened.

Further objectives and advantages of the present invention will become apparent as the following description proceeds, and the features of novelty which are set forth in the claims annexed to and forming a part of this invention.

DETAILED DESCRIPTION OF THE PREFERRED EMBODIMENT

Figure 1:
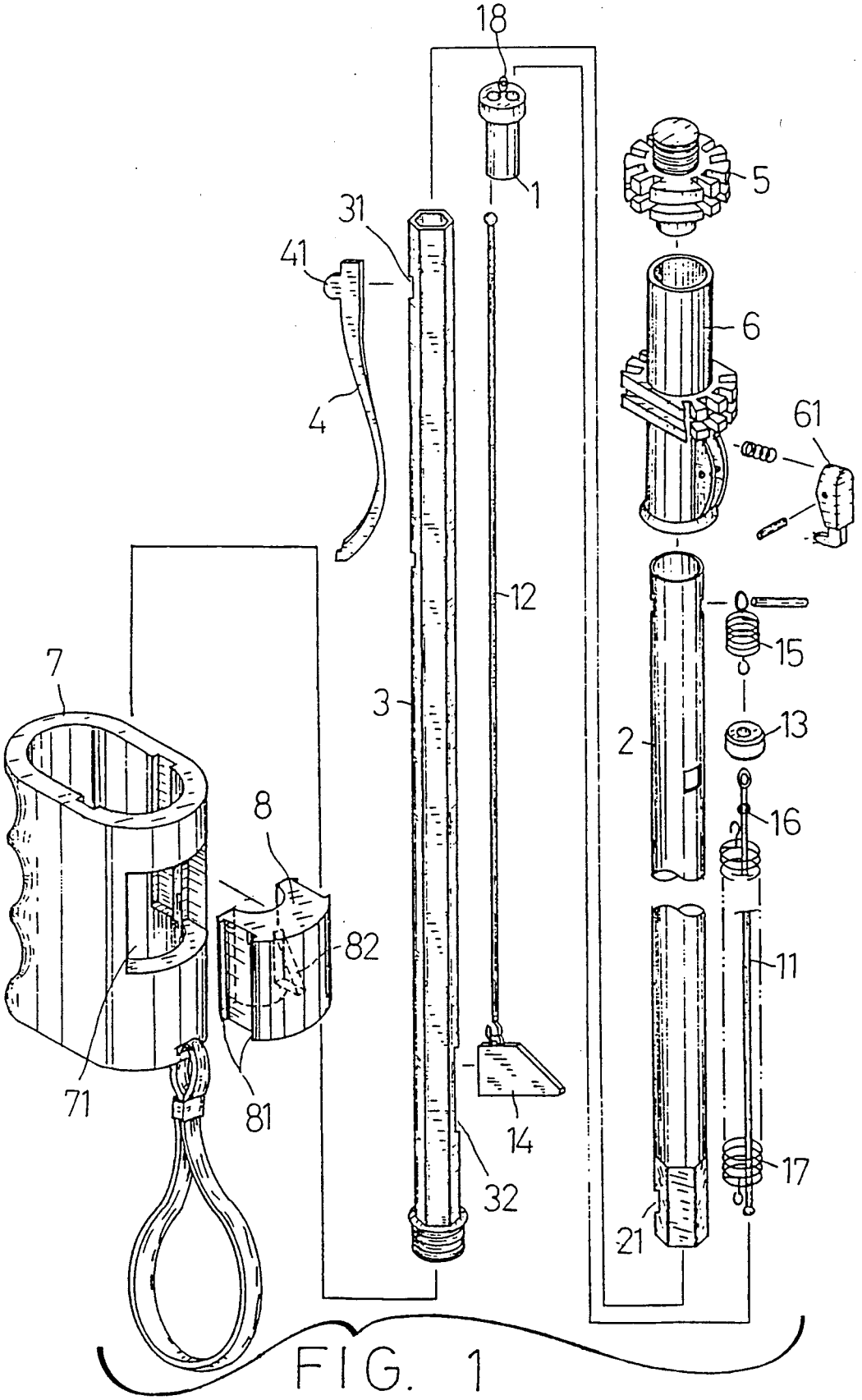
FIG. 1 is an exploded perspective view in accordance with the present invention.
Figures 2, 2A, 2B, 2C:
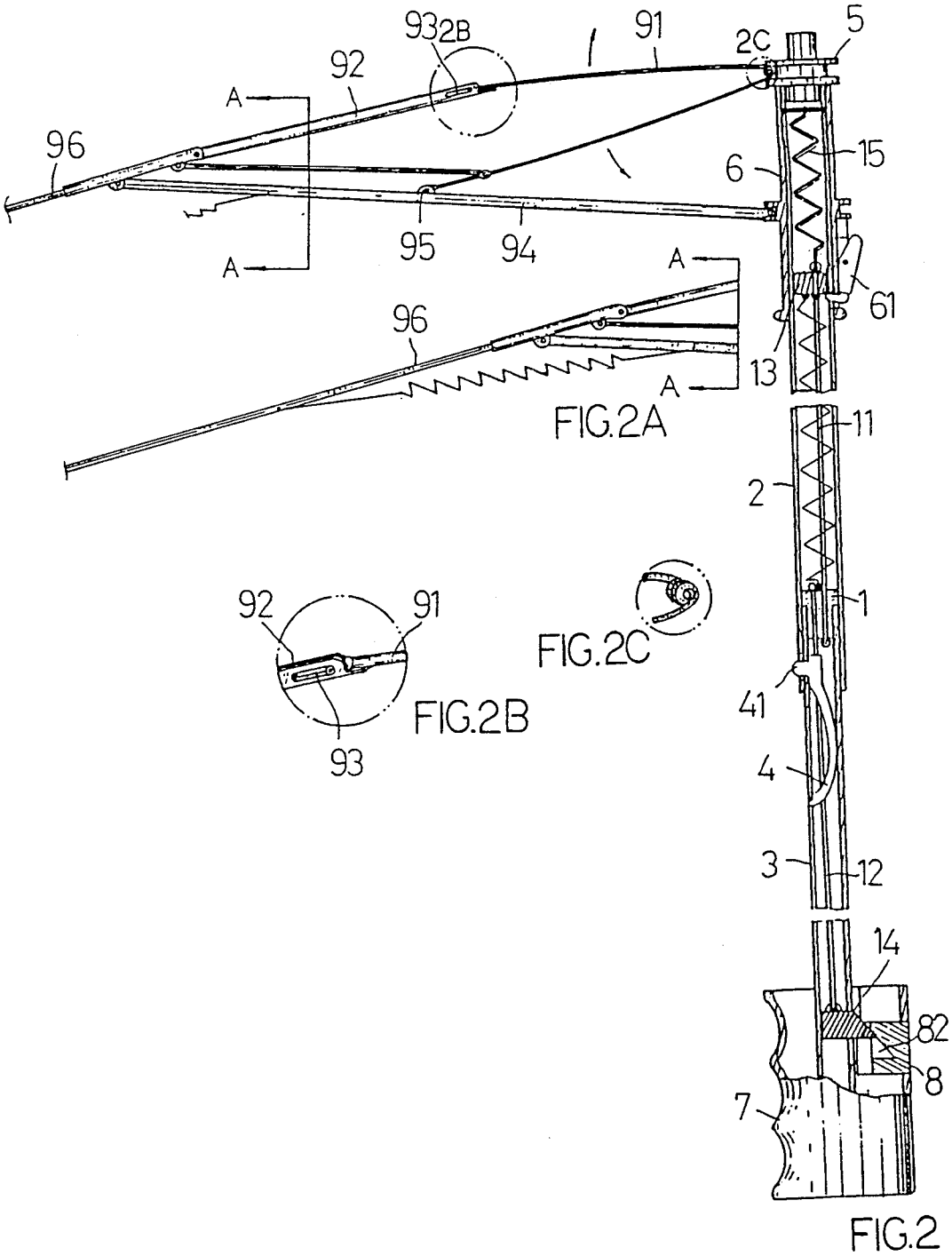
FIG. 2 is a cross-sectional view of an open embodiment in accordance with the present invention.
FIG. 2A is an enlarged view taken along lines A—A of FIG. 2.
FIG. 2B is an enlarged view taken along circle B of FIG. 2.
FIG. 2C is an enlarged view taken along circle C of FIG. 2.

Referring to FIGS. 1 and 2, it can be seen that the present invention includes a center shaft of an inner tube (3) and an outer tube (2). A spring pawl (4) is connected within the inner tube (3) and has a protrusion (41) on its top end. The top end of the inner tube (3) having a side hole (31) is inserted into the bottom end having a side hole (21), while the protrusion (41) is engaged with two holes (21) and (31) to make an extended state of center shaft. A connector (1) with an upper link (11) and a lower link (12) is provided in the center shaft, wherein two links are slidable relating to the connector (1) but can not be separated. A ring (13) is connected with the top of the upper link (11) and a key (14) is connected with the bottom of the lower link (12). A slider (6) is slidably provided around the center shaft and has a stopper (61) adapted to engage with a hole (22) on the outer tube (2) to maintain an opened state of the umbrella. A crown (5) is connected with the top of the outer tube (2) and adapted to pivotally connect with ribs (91), as shown in FIG. 2A. A second rib (92) is connected with a rib (91), wherein an oval hole (93) is formed on the second rib (92) and adapted to make a slidable connection, such as in FIG. 2B. A supporting rod (94) is pivotally connected at one end to the slider (6) and at the other end to an end rib (96). The folded end of the rib (91) is extendedly connected at the middle of the supporting rod (94). Accordingly, the umbrella has an arc form when it is opened.

A spring (15) connects its lower end with the top of the upper link (12) and its upper end with a pin which is laterally fixed on the upper portion of the outer tube (2). The ring (13) is fixed at the place between the ring-shaped top and a widened flange (16) of the upper link (12). A spring (17) connects its upper end with the ring (13) and lower end with a hook (18) on the connector (1).

A handle (7) is connected with the bottom of the inner tube (3). The handle (7) has a side aperture (71) and the inner tube (3) has a side slot (32). A button (8) has two pairs of flanges on both sides and is placed within the aperture (71) of the handle (7) while remaining a moving space. The button (7) has an inner triangular chamber (82) opposite to the slot (32) of the inner tube (3). The key (14) is connected with the bottom of the lower link (12) and has an inclined portion adapted to pass through the slot (32) and to be received in the triangular chamber (82).

Figures 3, 3A:
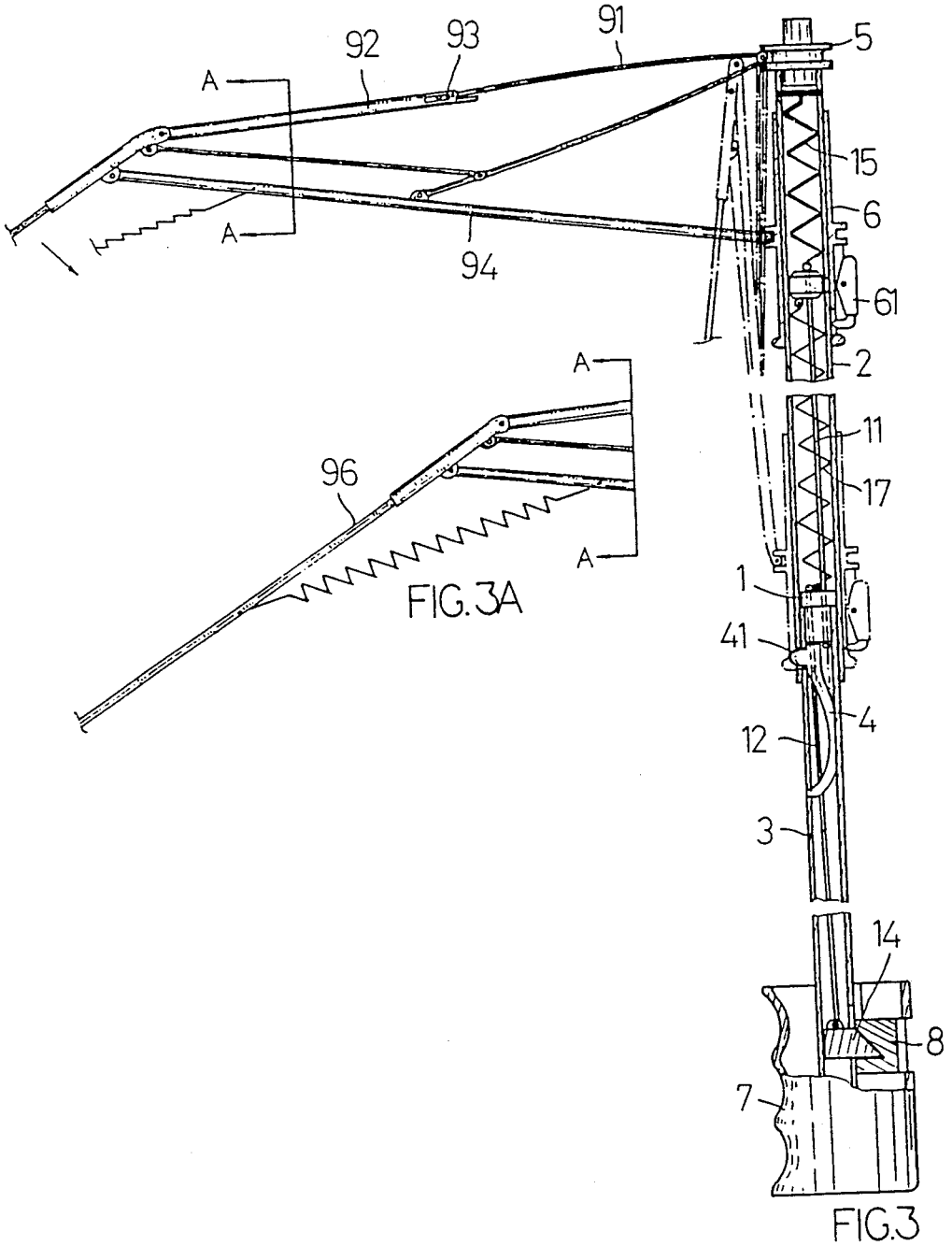
FIG. 3 is a cross-sectional view of a semi-closed embodiment in accordance with the present invention.
FIG. 3A is an enlarged view taken along lines A—A of FIG. 3.
Figure 4:
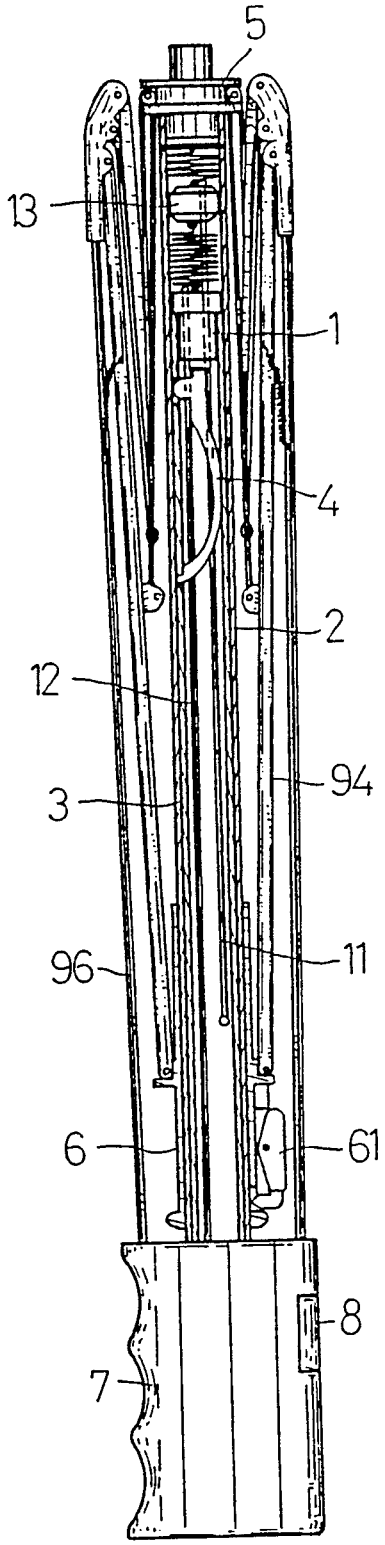
FIG. 4 is a cross-sectional view of a full closed embodiment in accordance with the present invention.

Referring to FIGS. 2–4, in use, the umbrella is opened by depressing protrusion (41) and with one hand, manually pushing outer tube (2) away from handle (7) against the bias of springs (15) and (17) while holding the handle (7) with the other hand. One need only push the button (8) to close and shorten the umbrella automatically. It can be understood that the triangular chamber (82) will force the piece (14) moving downward when the button (8) is pushed. The lower link (12), the connector (1), the upper link (11), and the ring (13) are moved downward at the same time, while the ring (13) is capable of pushing the stopper (61) outward to release the engagement of the slider (6) which slides downward and the umbrella is closed as shown in dot lines of FIG. 3. As the slider (6) slides down to contact with the protrusion (41) of the spring pawl (4) and to push the protrusion inward, the engagement between the outer tube (2) and the inner tube (3) is released. Due to the elastic force of the springs (15) and (17), the connector (1), the lower link (12), the key (14), and the inner tube (3) are forced upward to insert into the outer tube (2). The umbrella is thus capable of being closed and shortened automatically by a single touch of the button on the handle.

As various possible embodiments might be made of the above invention without departing from the scope of the invention, it is to be understood that all matter herein described or shown in the accompanying drawings is to be interpreted as illustrative and not in a limiting sense. Thus, it will be appreciated that the drawings are exemplary of a preferred embodiment of the invention.

We claim:

1. A one hand operated umbrella capable of self-closing including an inner tube and an outer tube defining a center shaft; a connector inside the center shaft having an upper link and a lower link, wherein the two links are slidable relating to the connector but can not be separated; a ring connected to the top of the upper link; a key connected to the bottom of the lower link; a slider slidably mounted on the outer tube and having a stopper adapted to engage with a hole on the outer tube to maintain an opened state of the umbrella; and a crown being connected with the top of the outer tube and adapted to pivotally connect with ribs; characterized in that a spring pawl being connected within the inner tube and having a protrusion on its top end, the top end of the inner tube having a side hole being inserted into the bottom end of the outer tube having a side hole, and the protrusion engaging with the two holes to make an extended state of the center shaft;

a second rib being relatively connected with one of the ribs, wherein a hole is formed on the second rib and adapted to make a slidable connection with the one rib, and a supporting rod being pivotally connected at one end to the slider, and at the other end to an end rib, the folded end of the rib being extendedly connected with the middle of the supporting rod;

a spring connecting its lower end with the top of the upper link and its upper end with a pin which is laterally fixed on an upper portion of the outer tube, and the ring being fixed at the place between a ring-shaped top and a widened flange of the upper link, and a second spring connecting its upper end with the ring and its lower end with a hook on the connector;

a handle being connected with the bottom of the inner tube and having a side aperture; the inner tube having a side slot; a button having two pairs of flanges on both sides and positioned within the aperture of the handle, the botton also having an inner triangular chamber opposite the slot of the inner tube; and the key being connected with the bottom of the lower link and having an inclined portion adapted to pass through the slot and to be received in the triangular chamber.

* * * * *